US010892072B1

(12) United States Patent
Tseng et al.

(10) Patent No.: US 10,892,072 B1
(45) Date of Patent: Jan. 12, 2021

(54) PTC DEVICE

(71) Applicant: Polytronics Technology Corp., Hsinchu (TW)

(72) Inventors: Chun-Teng Tseng, Miaoli County (TW); Yao-Te Chang, Yunlin County (TW); Wen Feng Lee, Taoyuan (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 16/844,585

(22) Filed: Apr. 9, 2020

(30) Foreign Application Priority Data

Aug. 15, 2019 (TW) ..... 108129030 A

(51) Int. Cl.
*H01C 7/02* (2006.01)
*H01C 1/14* (2006.01)

(52) U.S. Cl.
CPC ..... *H01C 7/027* (2013.01); *H01C 1/1406* (2013.01); *H01C 7/021* (2013.01)

(58) Field of Classification Search
CPC ..... H01C 7/027; H01C 7/021; H01C 1/1406
See application file for complete search history.

(56) References Cited

U.S. PATENT DOCUMENTS 4,899,032 A * 2/1990 Schwarzl ..... H05B 3/141 219/540
5,028,763 A * 7/1991 Chung-Tai ..... H05B 3/14 219/505
5,262,754 A * 11/1993 Collins ..... H01C 7/105 338/20
6,377,467 B1 4/2002 Chu et al.
6,711,807 B2 * 3/2004 Duggal ..... H01C 1/1406 29/610.1
6,750,754 B2 * 6/2004 Wang ..... H01C 1/1406 338/22 R
7,071,810 B2 * 7/2006 Ma ..... H01C 7/13 338/21
8,193,898 B2 * 6/2012 Tonouchi ..... H01C 17/28 338/204
8,902,039 B2 * 12/2014 Suzuki ..... H01C 7/102 338/21
9,007,166 B2 4/2015 Tseng et al.
10,614,935 B1 * 4/2020 Tseng ..... H01C 7/021
2013/0169405 A1 * 7/2013 Okinaka ..... H01C 7/12 338/21

(Continued)

*Primary Examiner* — Kyung S Lee
(74) *Attorney, Agent, or Firm* — Muncy, Geissler, Olds & Lowe, P.C.

(57) ABSTRACT

A PTC device comprises a laminated substrate, a first PTC material layer, a second PTC material layer, a first metal layer and a second metal layer. The laminated substrate comprises a first conductive layer, a second conductive layer and an insulating layer laminated between the first and second conductive layers. The first PTC material layer is disposed on the first conductive layer, and the second PTC material layer is disposed on the second conductive layer. The first metal layer is disposed on the first PTC material layer, and the second metal layer is disposed on the second PTC material layer. The insulating layer has a through hole filled with PTC material to form a PTC connecting member of which one end connects to the first PTC material layer and another end connects to the second PTC material layer.

11 Claims, 5 Drawing Sheets

(56) References Cited

U.S. PATENT DOCUMENTS

2014/0146432 A1* 5/2014 Wang ..... H01C 7/021
361/93.7
2015/0146334 A1* 5/2015 Tseng ..... H05K 3/3442
361/93.1

* cited by examiner

PTC DEVICE

BACKGROUND OF THE INVENTION

(1) Field of the Invention

The present application relates to a thermistor. More specifically, it relates to a positive coefficient temperature (PTC) device.

(2) Description of the Related Art

PTC devices can be used for protecting circuitries from damages resulted from over-heat or over-current. A PTC device usually contains two electrodes and a resistive material disposed therebetween. The resistive material has PTC characteristic that the resistance thereof remains extremely low at room temperature and instantaneously increases to thousand times when the temperature reaches a critical temperature or the circuit has over-current so as to suppress over-current and protect the cell or the circuit device. Moreover, the PTC device can be applied to an over-temperature sensing circuit, it detects ambient temperature upon which proper action. e.g., power off, is activated for over-temperature protections. When the material gets back to the room temperature or over-current no longer exists, the over-current protection device returns to be of low resistance and as a consequence the circuitry can operate normally. In view of the reusability, the PTC over-current protection devices can replace traditional fuses and have been widely applied to high density circuits.

With lightweight and compact trends, electronic apparatuses are getting smaller. For a cell phone, a number of components have to be integrated into a limited space, in which an over-current protection device is usually secured to a protective circuit module (PCM) and its external lead will occupy a certain space. Therefore, it is desirable to have a thin-type protection device that does not take up much room. When the device is downsizing to form factor 0201, it is a great challenge on how to decrease the thickness of the protection device for surface-mount applications.

According to specification of 0201, a device has a length of 0.6±0.03 mm, a width of 0.3±0.03 mm and a thickness of 0.25±0.03 mm. In manufacturing, the length and width are doable, but the thickness is too thin to be achieved. Nowadays, the resistive material substrate of carbon black system can be at most pressed to 0.2 mm in thickness, and the resistive material substrate of ceramic filler system can obtain a thickness of 0.2-0.23 mm. If the resistive material substrate is further engaged with insulating (prepreg) layers and internal and external circuits (electrodes) to form an over-current protection device as shown in U.S. Pat. No. 6,377,467, not only is the thickness out of specification but also the thickness may be equal to or larger than width. As a result, the devices may topple when they are subjected to packaging or other processes afterwards. Moreover, the internal-and-external circuit design on a small size device sometimes has misalignment between the internal circuit and external circuit, and therefore the production yield will be negatively impacted.

U.S. Pat. No. 9,007,166 proposes solution to the aforesaid problem. Without prepreg layers and external electrode layers, a PTC composite substrate is devised to etch or cut an electrode layer of the PTC substrate to form a groove isolating right and left electrodes, so as to control the thickness of the PTC over-current protection device to be smaller than or equal to 0.28 mm. However, the electrode layers of the PTC device are not symmetrical, and therefore there is a need to verify the orientation of the PTC device under electric testing and packaging. Moreover, the groove may be misaligned due to inflation and retraction of the PTC material during manufacturing, right and left electrodes of unequal areas influence electric characteristic. Without support of prepreg layers, the PTC device may flaw due to insufficient strength during manufacturing.

SUMMARY OF THE INVENTION

The present application provides a PTC device characterized in over-current protection and/or over-temperature sensing. In view of simple structure and manufacturing process, the PTC device is suitable to be made in the sizes of 0402 or 0201. The PTC device has no internal circuit, and thus there is no concerns of material inflation and retraction and misalignment between internal and external circuits. Moreover, the PTC device still has prepreg supports at two sides, thereby enhancing structural strength and increasing manufacturing yield.

In accordance with an embodiment of the present application, a PTC device comprises a laminated substrate, a first PTC material layer, a second PTC material layer, a first metal layer and a second metal layer. The laminated substrate comprises a first conductive layer, a second conductive layer and an insulating layer laminated between the first and second conductive layers. The first PTC material layer is disposed on the first conductive layer, and the second PTC material layer is disposed on the second conductive layer. The first metal layer is disposed on the first PTC material layer, and the second metal layer is disposed on the second PTC material layer. The insulating layer has a through hole filled with PTC material to form a PTC connecting member of which one end connects to the first PTC material layer and another end connects to the second PTC material layer.

In an embodiment, the first metal layer, the first PTC material layer, the laminated substrate, the second PTC material layer and the second metal layer are laminated in order.

In an embodiment, the insulating layer has a glass transition temperature (Tg) equal to or greater than 140° C.

In an embodiment, the insulating layer comprises prepreg, bismaleimide modified triazine resin (BT), polyimide resin (PI), diphenylene ether resin (PPO) or polyolefin resin.

In an embodiment, the PTC device further comprises two leads disposed on the first metal layer and the second metal layer.

In an embodiment, the first PTC material layer, the second PTC material layer and the PTC connecting member are integrally formed in one body.

In an embodiment, the lateral surfaces of the PTC connecting member are encapsulated by the insulating layer.

In an embodiment, the PTC device further comprises a first electrode layer and a second electrode layer. The first electrode layer covers the first metal layer, lateral surfaces of the first PTC material layer and lateral surfaces of the first conductive layer. The second electrode layer covers the second metal layer, lateral surfaces of the second PTC material layer and lateral surfaces of the second conductive layer.

In an embodiment, the first electrode layer and the second electrode layer serve as soldering interfaces.

In an embodiment, the first electrode layer, the second electrode layer and the insulating layer form outer surfaces of the PTC device.

In an embodiment, the PTC device further comprises two leads disposed on the first electrode layer and the second electrode layer.

In accordance with the present application, the PTC device has no complicated internal circuit and therefore there is no concerns of inflation and retraction and misalignment between internal and external circuits. The PTC device can be simply made by pressing and is suitable to be made in small sizes such as 0402 or 0201. The PTC device may have equal width and height to avoid rollover issues.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
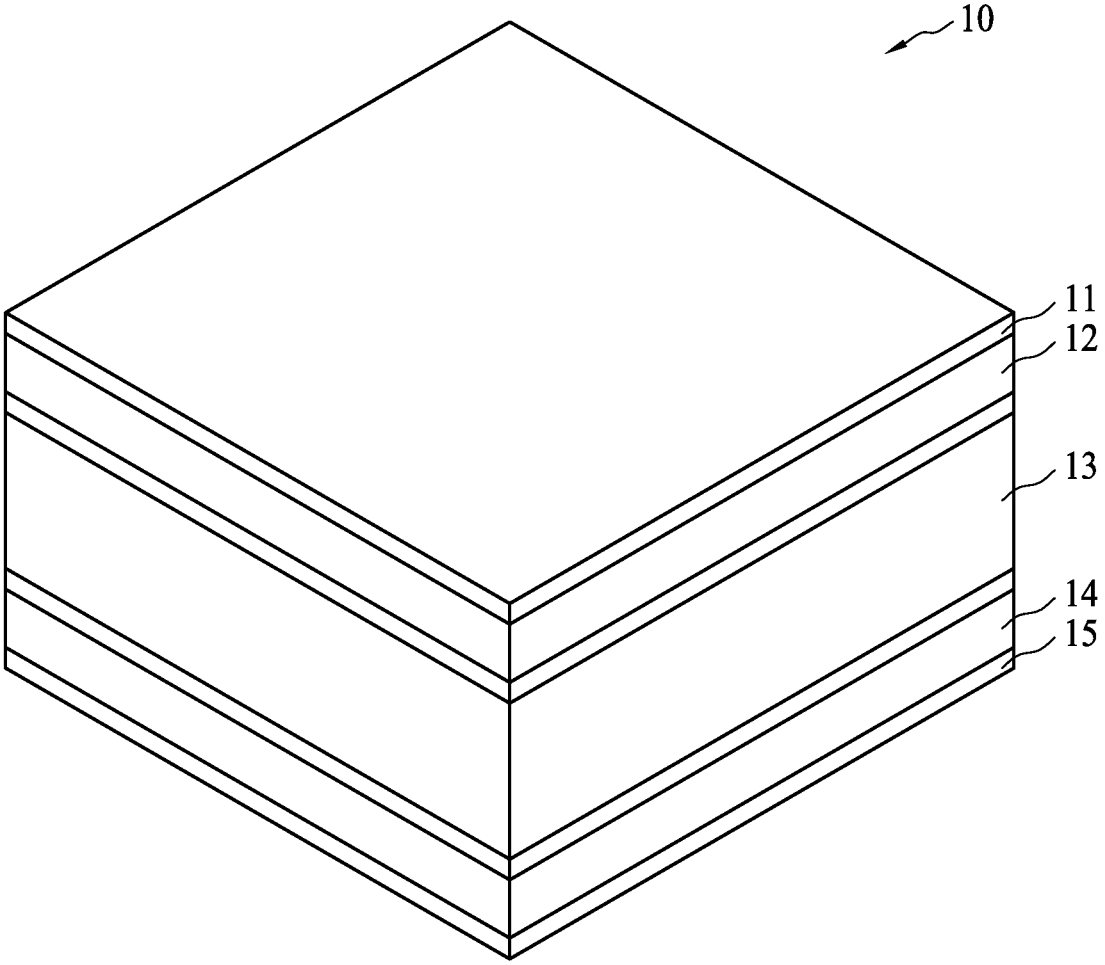
FIG. 1 shows a PTC device in accordance with a first embodiment of the present application.
Figure 2:
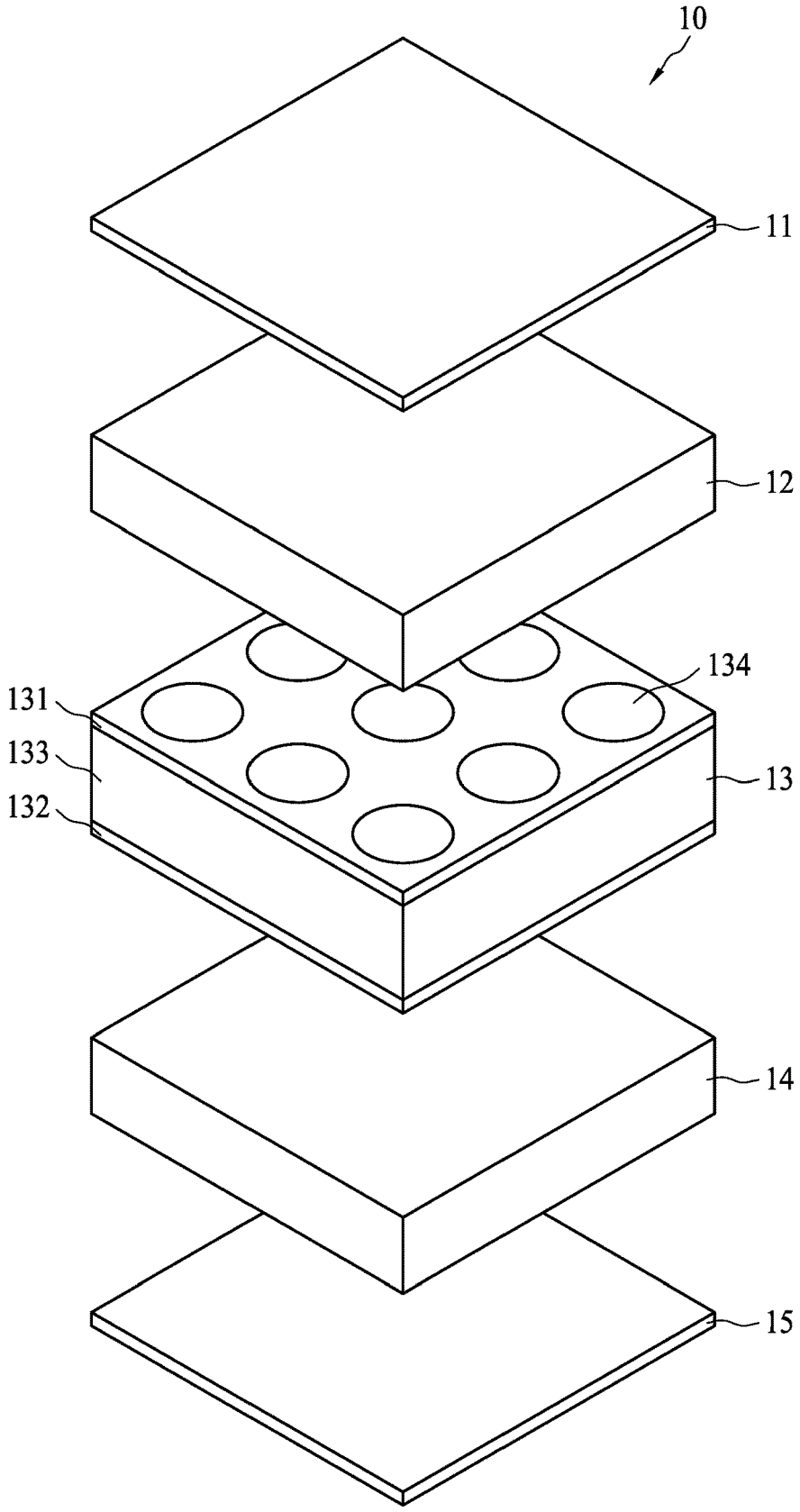
FIG. 2 shows an exploded view of the PTC device in accordance with the first embodiment of the present application.

FIG. 1 shows a perspective view of a PTC device in accordance with an embodiment of the present application. FIG. 2 shows an exploded view of the PTC device in FIG. 1. A PTC device 10 comprises a first metal layer 11, a first PTC material layer 12, a laminated substrate 13, a second PTC material layer 14 and a second metal layer 15. The laminated substrate 13 comprises a first conductive layer 131, a second conductive layer 132 and an insulating layer 133 laminated between the first conductive layer 131 and the second conductive layer 132. The first PTC material layer 12 is disposed on the first conductive layer 131, and the second PTC material layer 14 is disposed on the second conductive layer 132. The first metal layer 11 is disposed on the first PTC material layer 12, and the second metal layer 15 is disposed on the second PTC material layer 14. The insulating layer 13 comprises through holes filled with PTC material to form PTC connecting members 134. The PTC connecting member 134 has an end connecting to the first PTC material layer 12 and another end connecting to the second PTC material layer 14. In this embodiment, there are nine PTC connecting members 134 in a 3×3 array arrangement. The number of the PTC connecting members 134 can be varied as desired and is not limited to this embodiment.

The first conductive layer 131 and the second conductive layer 132 can be copper foils, and the insulating layer 133 preferably comprises a polymer with a glass transition temperature (Tg) equal to or greater than 140° C. For example, a polymer having Tg of 170° C. or 190° C. is used to withstand high temperature in hot injection molding. The insulating layer 133 may comprise prepreg, bismaleimide modified triazine resin (BT), polyimide resin (PI), diphenylene ether resin (PPO) or polyolefin resin. The first metal layer 11 and the second metal layer 15 may be copper electrodes or other conductive metal layers. The first PTC material layer 12, the second PTC material layer 14 and the PTC connecting members 134 comprise crystalline polymer and conductive filler dispersed in the crystalline polymer. The crystalline polymer may comprise polyethylene, polypropylene, polyvinyl fluoride, mixture or copolymer thereof. The conductive filler may comprise carbon-containing filler, metal filler, metal carbide filler, metal boride filler or metal nitride filler. For example, the metal filler may be nickel, cobalt, copper, iron, tin, lead, silver, gold, platinum, or the alloy thereof. The ceramic filler may be titanium carbide, titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), or zirconium nitride (ZrN). Moreover, the conductive filler may be the mixture, alloy, solid solution or core-shell of the aforesaid metal and ceramic fillers.

Figure 3:
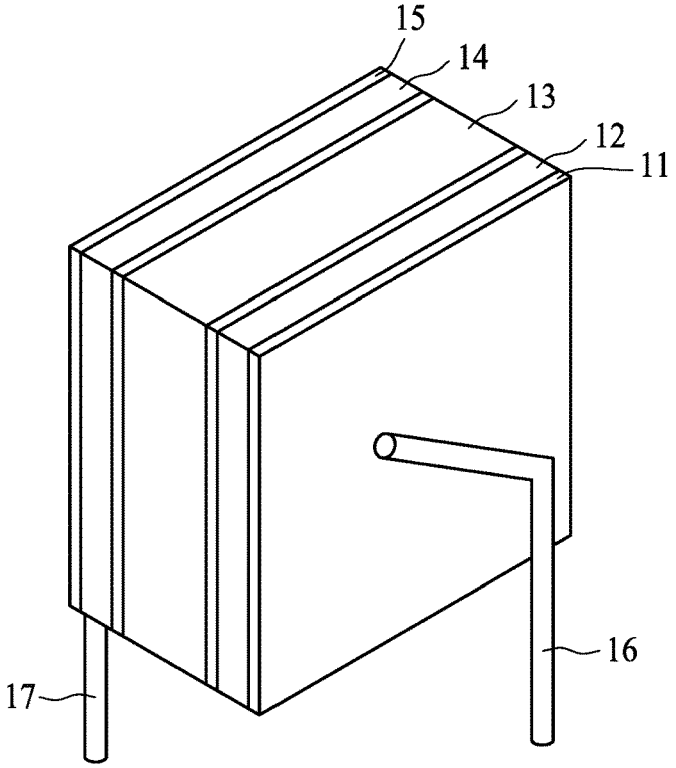
FIG. 3 shows a PTC device in accordance with a second embodiment of the present application.
Figure 4:
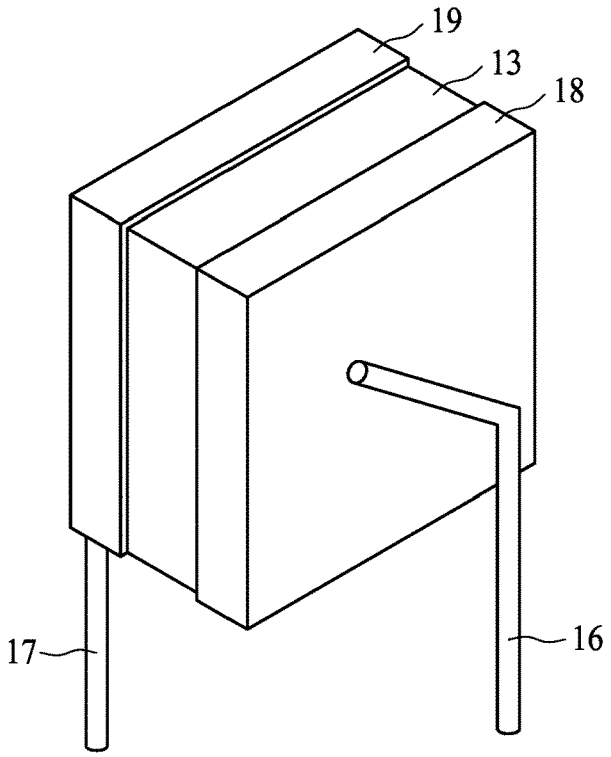
FIG. 4 shows a PTC device in accordance with a third embodiment of the present application.

FIG. 3 shows an embodiment in which leads 16 and 17 connect to the first metal layer 11 and the second metal layer 15 respectively to form a radial leaded PTC device. FIG. 4 shows another embodiment in which the surfaces of the first metal layer 11 and the second metal layer 15 and lateral surfaces of the first PTC material layer 12 and the second PTC material layer 14 are plated with a first electrode layer 18 and a second electrode layer 19 containing Cu—Ni—Sn or Cu—Ni—Ag alloy to increase solderability. Leads 16 and 17 connect to the first electrode layer 18 and the second electrode layer 19.

Figure 5:
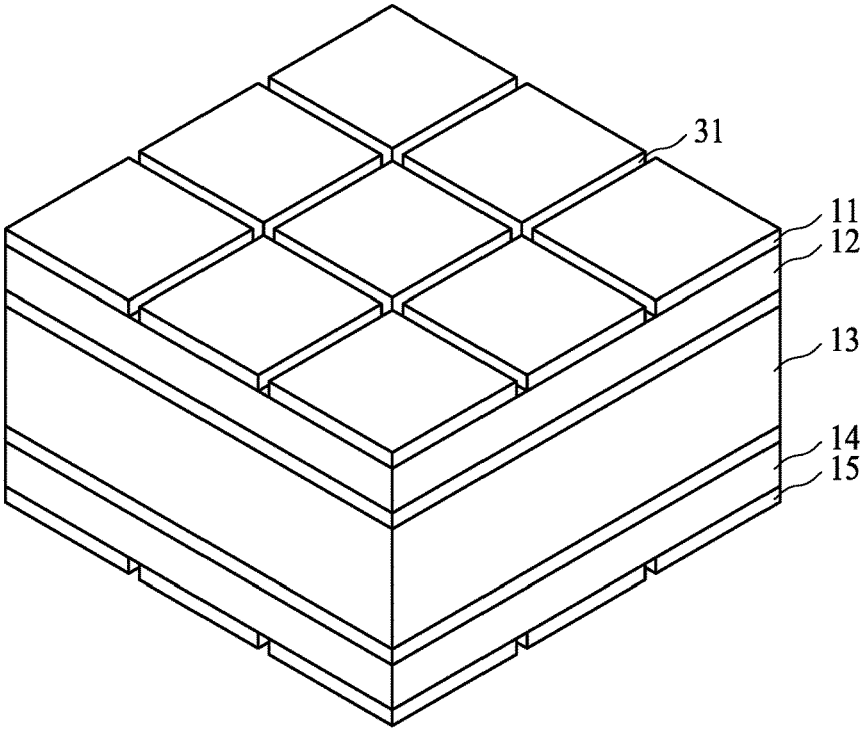
FIG. 5 and FIG. 6 show a way of making a PTC device in accordance with an embodiment of the present application.
Figure 6:
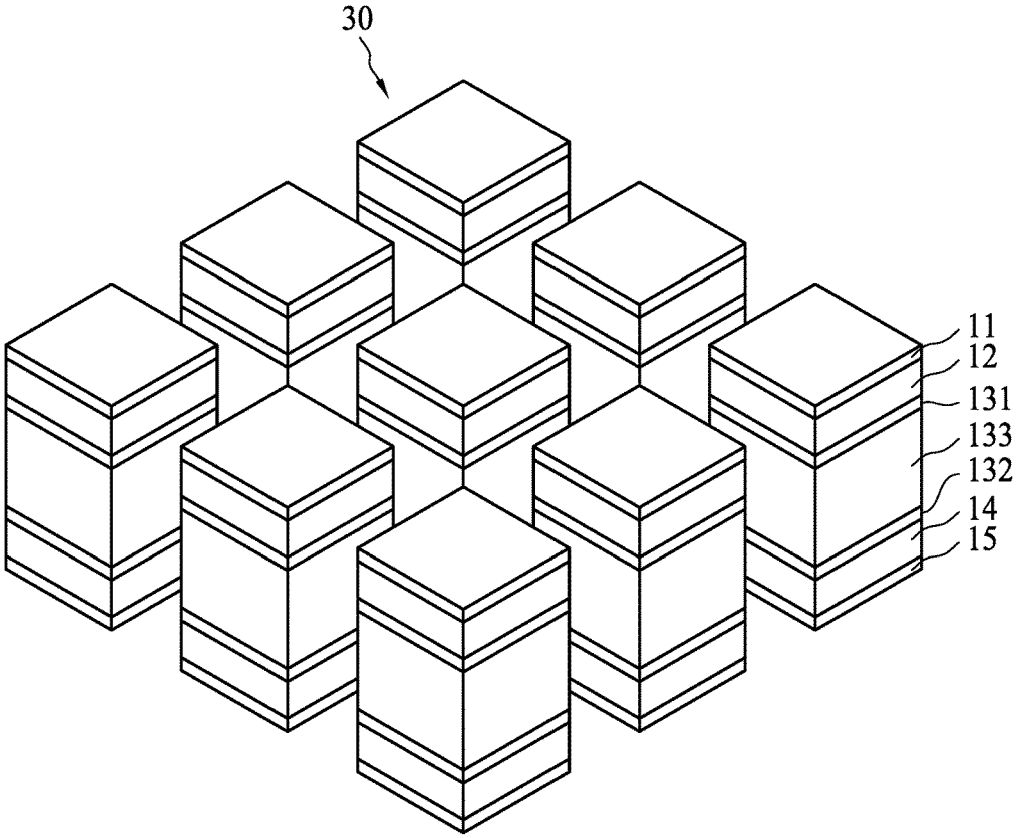
Figure 7:
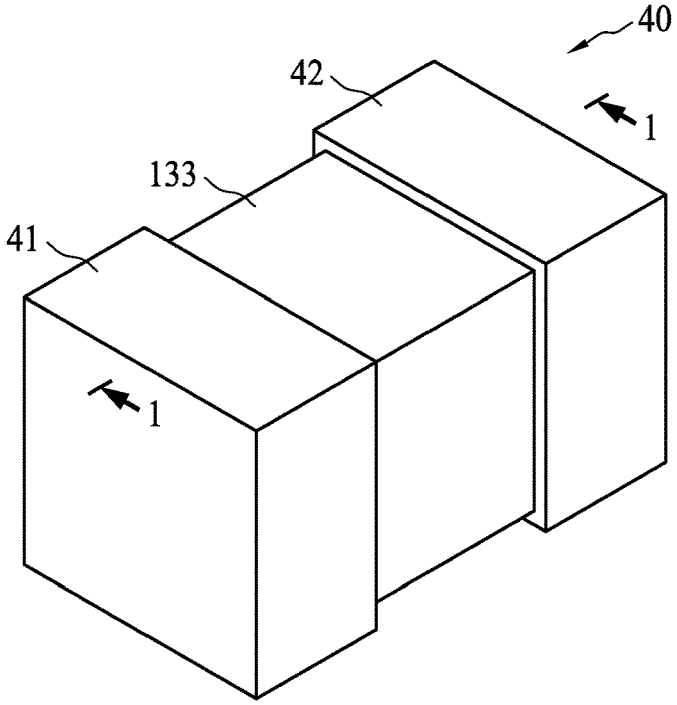
FIG. 7 shows a PTC device in accordance with a fourth embodiment of the present application.
Figure 8:
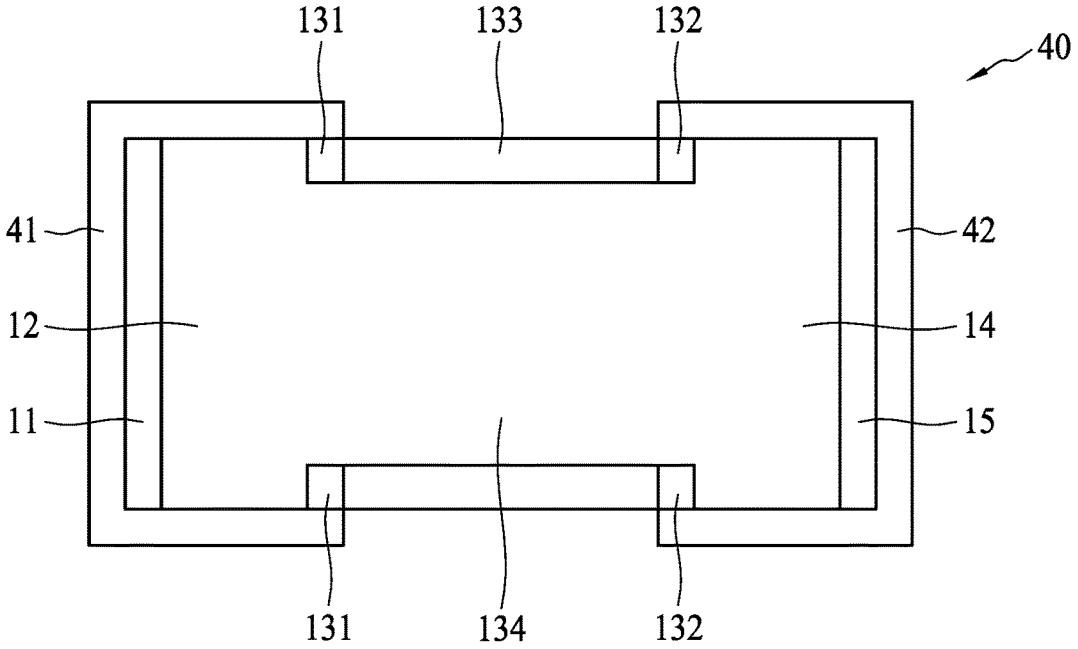
FIG. 8 shows a cross-sectional view along line 1-1 in FIG. 7.

In addition, the PTC device may be further processed to form smaller PTC devices of 0402 or 0201 size. Referring to FIG. 5 and FIG. 6, cutting lines 31 are formed in the first metal layer 11, and the device 10 is cut along the cutting lines 31 to form a plurality of devices 30. The insulating layer 133 of each device 30 comprises at least one PTC connecting member 134 in connection with the first PTC material layer 12 and the second PTC material layer 14. Then, the surfaces of the first metal layer 11 and the second metal layer 15 and lateral surfaces of the first PTC material layer 12 and the second PTC material layer 14 are plated with Cu—Ni—Sn or Cu—Ni—Ag alloy to form a first electrode layer 41 and a second electrode layer 42 as two end electrodes for soldering. The first electrode layer 41 and the second electrode layer 42 enhance solderability. As a result, a PTC device is formed as shown in FIG. 7. FIG. 8 shows a cross-sectional view along line 1-1 in FIG. 7. Lateral surfaces of the PTC connecting member 134 is encapsulated with the insulating layer 133, and the PTC connecting member 134 connects to the first PTC material layer 12 and the second PTC material layer 14 at two ends. The first electrode layer 41 covers the first metal layer 11, lateral surfaces of the first PTC material layer 12 and lateral surfaces of the first conductive layer 131. A second electrode layer 42 covers the second metal layer 15, lateral surfaces of the second PTC material layer 14 and lateral surfaces of the second conductive layer 132. The first and second electrode layers 41 and 42 form two end electrodes of the device 40. In an embodiment, the first electrode layer 41, the second electrode layer 42 and the insulating layer 133 form outer surfaces of the PTC device 40 so that the first PTC material layer 12, the second PTC material layer 14 and the PTC connecting member 134 are not exposed to outside to avoid PTC material deterioration due to oxygen or moisture intrusion. Preferably, the PTC device 40 has same width and thickness to avoid rollover issues.

In summary, the PTC device 40 may be made by the following steps of (1) drilling a laminated substrate to form through holes; (2) pressing metal layers and PTC material onto upper and lower surfaces of the laminated substrate; (3) filling PTC material into the through holes during pressing; (4) etching the metal layers to form cutting lines; (5) cutting the structure into a plurality of small individual devices; and (6) the individual device are electroplated with electrode layers. The laminated substrate contains high Tg polymer to avoid deformation and facilitate filling PTC material into the through holes. Because the PTC connecting member can be formed by pressing PTC material into through holes, the first and second PTC material layers 12, 14 and the PTC connecting member 134 are integrally formed in on body with same PTC material.

In addition to over-current protection applications, the PTC device of the present application can conduct temperature sensing. The PTC device is made of a laminated substrate through pressing and cutting. Not only are the simple structure and manufacturing process, but also it is suitable to be made for small devices such as 0402 and 0201 sizes. The PTC device of the present application has the following advantages: (1) The PTC device may have the same width and thickness to avoid rollover issues. (2) Without internal circuit in the laminated substrate, the PC device does not have material inflation and retraction problem and misalignment between internal circuit and external circuit. (3) The use of a laminated substrate increases structural strength. (4) PTC material is pressed into the through holes of the laminated substrate by which it can withstand rigorous hot injection molding. (5) The metal layers and the lateral surfaces of the PTC material layers can be plated with electrode layers that fully encapsulate the metal layers and the PTC material layers so as to increase structural strength of the device. (6) Unlike traditionally horizontal stack design, the laminated substrate in vertical stack has more flexibility to adjust the thickness if there is a need to increase voltage endurance. (7) Because the PTC material is conductive, electrode layers can be formed by electroplating directly and silver dip can be omitted.

The above-described embodiments of the present invention are intended to be illustrative only. Numerous alternative embodiments may be devised by persons skilled in the art without departing from the scope of the following claims.

What is claimed is:

1. A PTC device, comprising:

a laminated substrate, comprising a first conductive layer, a second conductive layer and an insulating layer laminated between the first and second conductive layers;

a first PTC material layer disposed on the first conductive layer, a second PTC material layer disposed on the second conductive layer, a first metal layer disposed on the first PTC material layer; and a second metal layer disposed on the second PTC material layer;

wherein the insulating layer has a through hole filled with PTC material to form a PTC connecting member of which one end connects to the first PTC material layer and another end connects to the second PTC material layer.

2. The PTC device of claim 1, wherein the first metal layer, the first PTC material layer, the laminated substrate, the second PTC material layer and the second metal layer are laminated in order.

3. The PTC device of claim 1, wherein the insulating layer has a glass transition temperature equal to or greater than 140° C.

4. The PTC device of claim 1, wherein the insulating layer comprises prepreg, bismaleimide modified triazine resin, polyimide resin, diphenylene ether resin or polyolefin.

5. The PTC device of claim 1, further comprising two leads disposed on the first metal layer and the second metal layer.

6. The PTC device of claim 1, wherein the first PTC material layer, the second PTC material layer and the PTC connecting member are integrally formed in one body.

7. The PTC device of claim 1, wherein the lateral surfaces of the PTC connecting member are encapsulated by the insulating layer.

8. The PTC device of claim 1, further comprising:

a first electrode layer covering the first metal layer, lateral surfaces of the first PTC material layer and lateral surfaces of the first conductive layer; and a second electrode layer covering the second metal layer, lateral surfaces of the second PTC material layer and lateral surfaces of the second conductive layer.

9. The PTC device of claim 8, wherein the first electrode layer and the second electrode layer serve as soldering interfaces.

10. The PTC device of claim 8, wherein the first electrode layer, the second electrode layer and the insulating layer form outer surfaces of the PTC device.

11. The PTC device of claim 8, further comprising two leads disposed on the first electrode layer and the second electrode layer.

* * * * *